US005205784A

United States Patent [19]

DeHart et al.

[11] Patent Number: 5,205,784

[45] Date of Patent: Apr. 27, 1993

[54] SECURITY SLOT DIFFUSER

[75] Inventors: Marvin L. DeHart, Mesquite, Tex.; Steven J. Bowser, Tuczon, Ariz.

[73] Assignee: Tomkins Industries, Inc., Dayton, Ohio

[21] Appl. No.: 751,809

[22] Filed: Aug. 30, 1991

[51] Int. Cl.[5] ..... F24F 7/08

[52] U.S. Cl. ..... 454/245; 169/54

[58] Field of Search ..... 454/245-248; 169/54

[56] References Cited

U.S. PATENT DOCUMENTS

| | | | |
|---|---|---|---|
| 1,177,779 | 4/1916 | Kerch | 454/247 |
| 1,245,123 | 10/1917 | Power | 454/246 |
| 1,660,689 | 2/1928 | Terry | 454/246 X |
| 2,657,625 | 11/1953 | Smith et al. | 454/246 |
| 3,010,378 | 11/1961 | Geocaris | 454/248 X |
| 3,291,028 | 12/1966 | Sylvester et al. | 454/245 |
| 3,722,152 | 3/1973 | Schlatter et al. | 52/79 |
| 4,505,189 | 3/1985 | Morris et al. | 98/40.19 |
| 4,970,834 | 11/1990 | Polson | 52/106 |

FOREIGN PATENT DOCUMENTS

| | | | |
|---|---|---|---|
| 257201 | 6/1988 | Fed. Rep. of Germany | 169/54 |

*Primary Examiner*—William E. Tapolcai

*Attorney, Agent, or Firm*—Richards, Medlock & Andrews

[57] ABSTRACT

A diffuser (10) is disclosed which is suitable for use in high security areas such as a jail. The diffuser is constructed of 10 gauge plate and defines an inlet passage (16) and a return passage (18). The return passage (18) can be utilized as a second inlet passage if desired. The air flow is through slots in a plate (34). A deflector portion (24) is curved over the slots to deflect the air in a first direction. In a second embodiment, a diffuser (100) is provided with slotted plates (102, 104) and a deflector (112) to discharge air in opposite horizontal directions.

7 Claims, 3 Drawing Sheets

SECURITY SLOT DIFFUSER

TECHNICAL FIELD OF THE INVENTION

This invention relates to the field of heating, ventilating and air conditioning, and particularly to an application where high security is required.

BACKGROUND OF THE INVENTION

To condition the temperature and humidity in a room or enclosure from a central heating and cooling unit, it is typical to mount a vent or distributor for inflow of air from the unit and a return duct to draw air from the room back to the unit. An important factor in designing the inlet vent is to distribute the inflowing air as uniformly as possible throughout the room and in a flow that attempts to minimize drafts.

Other considerations must be taken into account when the room to be conditioned is in a security area, such as a jail cell. For example, in a jail cell, a concern arises that the prisoner may vandalize units or otherwise alter their normal function. Several attempts have been made to provide ventilation units for security areas such as U.S. Pat. No. 4,505,189 to Morris et al. which discloses a vandal resistant and tamper-proof plenum vacuum chamber security airflow adjustment device, U.S. Pat. No. 3,722,152 to Schlatter et al. which discloses a portable jail cell and U.S. Pat. No. 4,970,834 to Polson which discloses a detention facility which has a mesh ceiling through which heating and ventilation air passes. A need exists, however, for a better design for a high security area.

SUMMARY OF THE INVENTION

In accordance with one aspect of the present invention, a diffuser is provided for air flow. The diffuser includes a frame having ends and a top and bottom and defining an opening therethrough. A divider plate is secured in the frame to divide the opening into a first passage and a second passage. A slotted plate is secured to the frame and the divider plate and is disposed across the first passage. The slotted plate has a plurality of slots formed therein for air flow through the first passage.

In accordance with another aspect of the present design, the divider plate has a deflector portion that extends over the slots in the slotted plate to direct the air flow through the slots in a first direction. In accordance with another aspect of the present invention, a grill is mounted to the frame and disposed across the second passage. A plenum can be mounted to the frame and open into the first passage. The second passage can form a return duct.

BRIEF DESCRIPTION OF THE DRAWINGS

With reference now to the following Detailed Description, taken in conjunction with the accompanying drawings, wherein.

DETAILED DESCRIPTION

Figure 3:
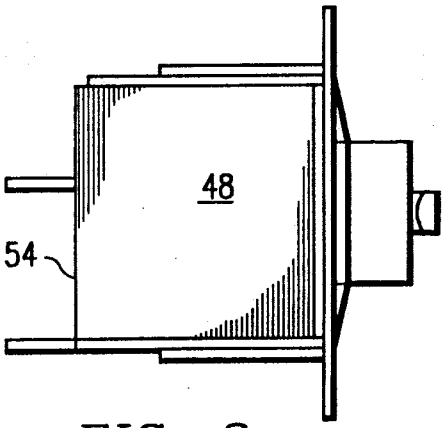
FIG. 3 is an end view of the diffuser.

With reference now to FIGS. 1–6, there is illustrated a security slot diffuser 10 forming a first embodiment of the present invention. The diffuser 10 includes a frame 12 and a plenum 14 and defines an inlet passage 16 and a return passage 18 in the same unit. As will be apparent from the description hereafter, the diffuser 10 is particularly suited for use in high security areas, such as a jail cell.

The diffuser 10 is constructed of a number of metal sheets, preferably of 10 gauge steel for strength, welded together to form the diffuser. A divider plate 20 is formed with a flat portion 22 and a curved deflector portion 24. A grill plate 26 (FIG. 6) has flat portion 28, an edge portion 29 and a grill portion 30 with a plurality of holes 32 therethrough.

A slotted plate 34 (FIG. 5) has an edge portion 36 and a curved slotted portion 38 which has a plurality of rectangular slots 39 formed therethrough. The slots are distributed along a single row to minimize the height of the diffuser to insure the mounting aperture for diffuser 10 is too small for a prisoner to crawl through. Supply neck plate 40 is flat. Plates 20, 26, 34 and 40 are welded together with edge plates 42 and 44, supporter bars 46 and 47, and end plates 48 and 50 to define the frame 12.

When assembled, the plates define an inlet passage 16 which extends from edges 52, 54, 56 and 58 of bottom plate 40, end plates 48 and 50 and divider plate 20, respectively through slots 39 in the slotted plate 34 to the curved deflector portion 24 of the divider plate 20. The plenum 14 can be mounted about the edges 52–58 to provide conditioned air into the inlet passage 16 for discharge from the diffuser 10. The curved deflector portion 24 will direct the air in a direction determined by the angle of the curved deflector portion. In one design, the angle of the deflector portion is 30° relative to the plane of the face of the diffuser. The return passage 18 is formed between the divider plate 20, grill portion 30 and the end plates 48 and 50. Air from the room being conditioned will pass into the front of the return passage and through the holes 32 for flow into a return plenum or cavity (not shown). If the diffuser 10 is mounted in the ceiling, the inlet passage 16 will provide a horizontal air discharge because of the deflection of the deflector portion 24. If the return passage 18 is utilized as a return duct, the return will be vertical. However, diffuser 10 can be employed as a two direction discharge diffuser by discharging air into the room through both passage 16 and passage 18. In that event, the discharge is both horizontal and vertical.

Figure 1:
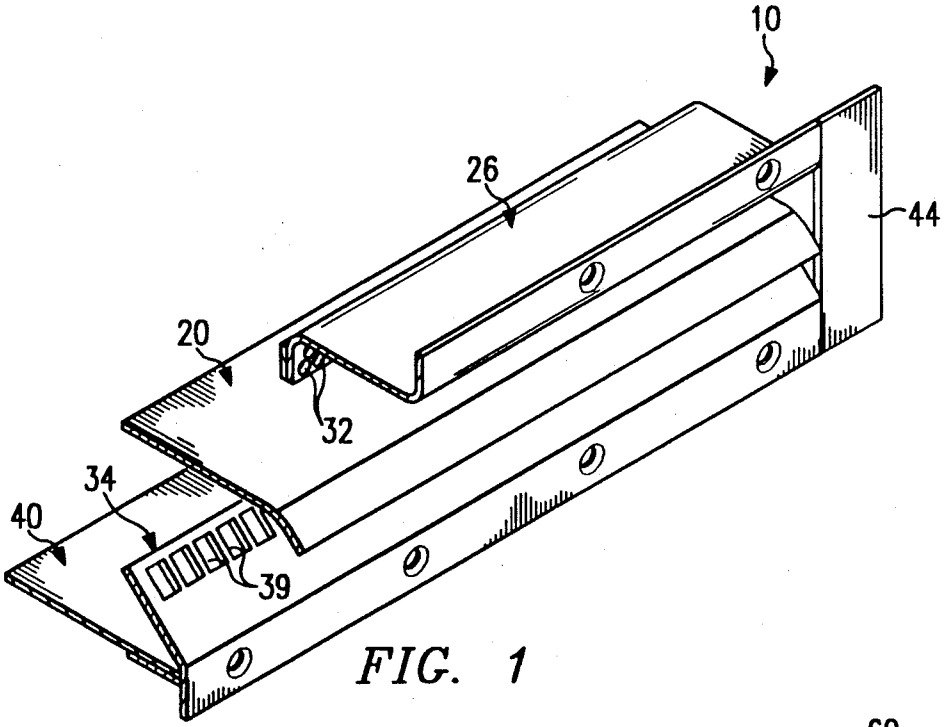
FIG. 1 is a perspective view of a diffuser forming a first embodiment of the present invention.
Figure 2:
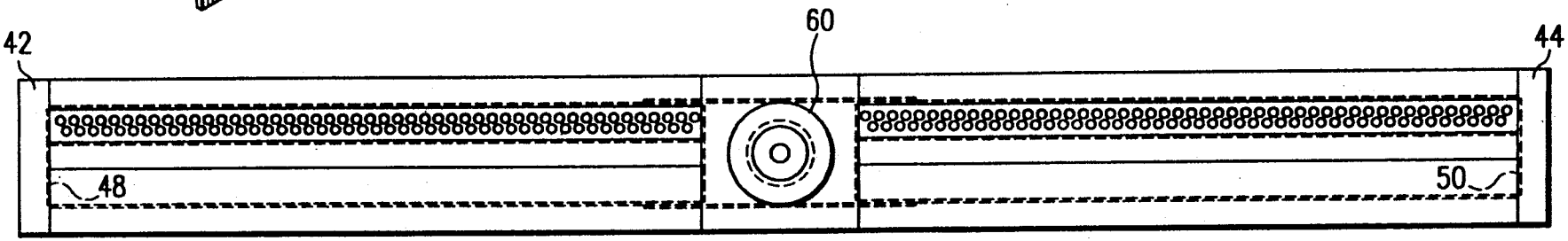
FIG. 2 is a front view of the diffuser.
Figure 4:
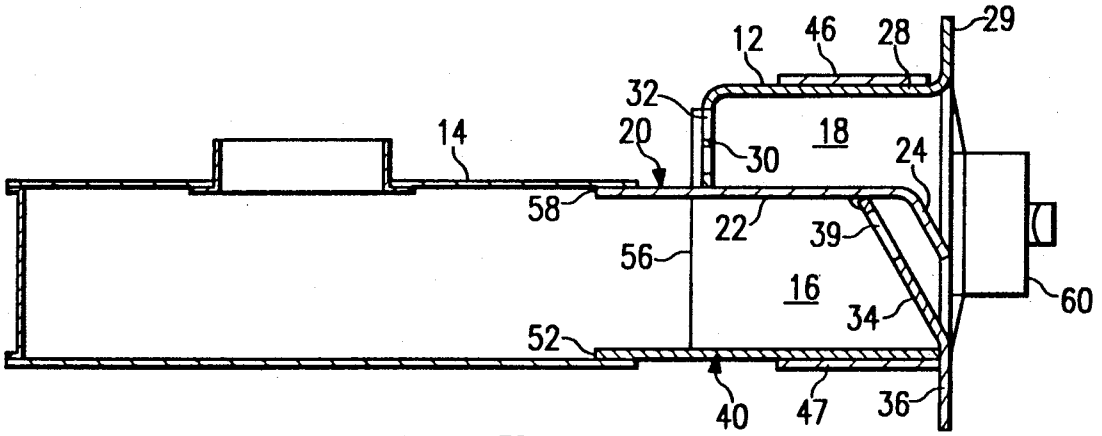
FIG. 4 is a cross-sectional view of the diffuser.
Figure 6:
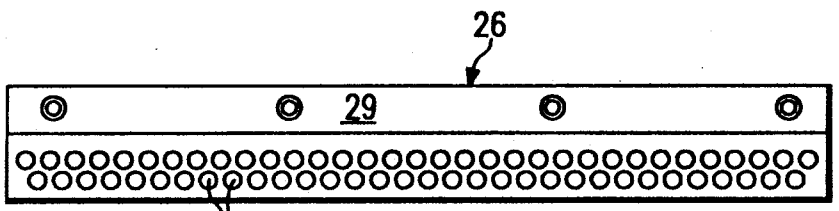
FIG. 6 is a front view of the grill plate.
Figure 5:
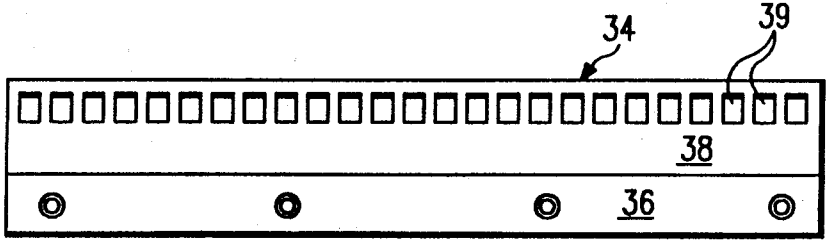
FIG. 5 is a front view of the slotted plate.

Referring now to FIG. 1, the diffuser 10 can be seen to be equipped with a integral sprinkler 60 which is connected to a source of water or other fire treating material. By combining the sprinkler and diffuser functions, both space and installation difficulties are reduced.

Figure 7:
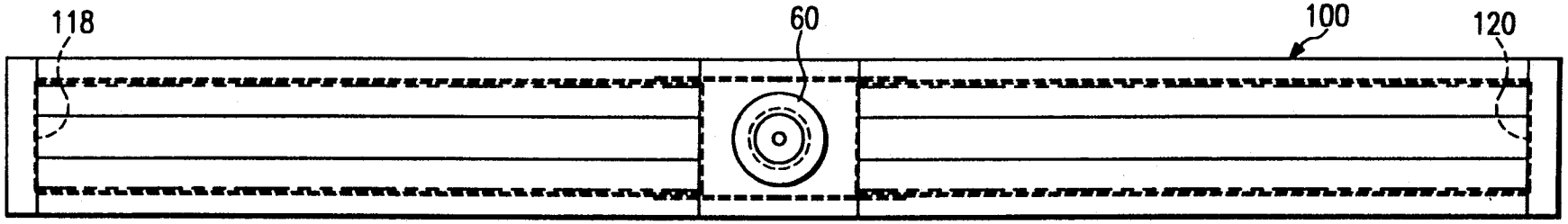
FIG. 7 is a front view of a diffuser forming a second embodiment of the present invention.
Figure 8:
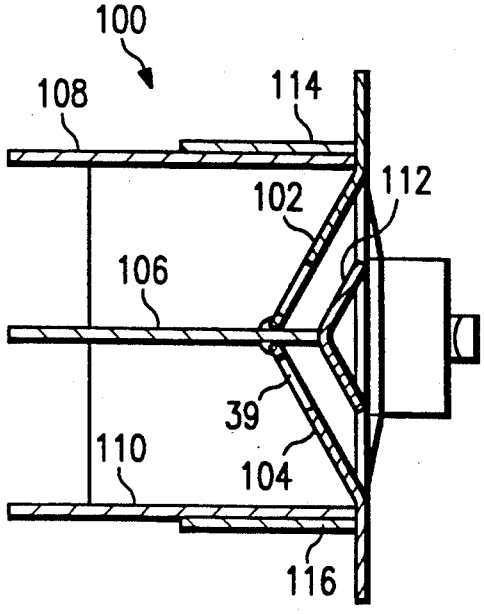
FIG. 8 is a cross-section view of the diffuser of FIG. 7.

With reference now to FIGS. 7 and 8, a second embodiment of the present invention is illustrated as security slot diffuser 100. Diffuser 100 is designed for two directional horizontal discharge and is formed of two slotted angle plates 102 and 104 welded to a neck plate 106 and supply plates 108 and 110. A deflector 112 is welded to the forward end of the neck plate 106. Support bars 114 and 116 are welded on the outside of each supply plate, and end plates 118 and 120 are welded at the ends of the diffuser. Preferably, the angles of the plates 102 and 104 and deflector 112 are about 30° from the plane of the front of the diffuser so that the air discharged is discharged at an angle of about 60° from a direction perpendicular to the face of the diffuser. If the slot diffuser 100 is mounted in the ceiling, the air flow will exit at an angle of about 30° down from the ceiling, which is essentially horizontal.

The slot diffuser 100 can also mount an integral sprinkler 60, as seen in FIG. 7.

Figure 9:
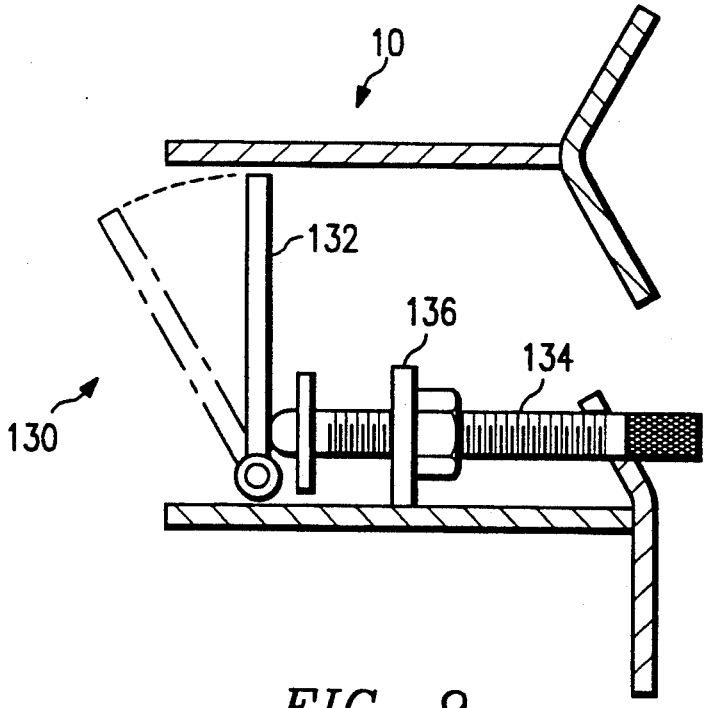
FIG. 9 is a detail view of a damper for the diffuser.

With reference to FIG. 9, a damper 130 can be mounted in the diffuser 10 if desired. The damper 130 includes a spring loaded damper blade 132 which is urged into a position to block the flow through the diffuser. An operator rod 134 is threaded into a support 136 with the end of rod 134 contacting the blade 132. The rod extends from the front of the diffuser so that the occupant can rotate the rod one way or the other to thread rod 134 into or out of support 136 and control the damper blade position.

While several embodiments of the present invention have been described in detail herein and shown in the accompanying drawings, it will be evident that further modifications and substitutions of parts and elements are possible without departing from the scope and spirit of the invention.

We claim:

1. A diffuser for air flow, the diffuser being a security diffuser resistant to tampering from the interior of the space into which the air flows, and to prevent the occupant of the space from escaping through the mounting aperture for the diffuser, comprising:

a frame having ends and a top and a bottom and defining an opening therethrough for mounting in an aperture, the aperture being too small for the occupant to crawl through;

a divider plate dividing the opening into a first passage and a second passage;

a slotted plate secured to the frame and said divider plate and disposed across the first passage, the slotted plate having a plurality of slots formed therein for air passage;

the divider plate having a deflector portion that extends over the slots in the slotted plate to direct the flow through the slots in a first direction, said plates and frame being secured together in a manner so that they cannot be disassembled by the occupant of the space.

2. The diffuser of claim 1 further comprising a plenum mounted to said frame to supply air to the first passage for discharge from the diffuser.

3. The diffuser of claim 1 further comprising a grill mounted to said frame disposed across the second passage, said grill having a plurality of openings.

4. The diffuser of claim 1 further comprising a sprinkler mounted to said frame.

5. The diffuser of claim 1 wherein said plates are formed of 10 gauge steel.

6. The diffuser of claim 1 further comprising a damper blade mounted for pivotal motion in said frame between a first position closing the first passage and a second position opening the first passage, and means for positioning the damping blade in a position between the first and second positions.

7. A diffuser for air flow, comprising:

a frame having ends and a top and a bottom and defining an opening therethrough;

a divider plate dividing the opening into a first passage and a second passage;

a slotted plate secured to the frame and said divider plate and disposed across the first passage, the slotted plate having a plurality of slots formed therein for air passage;

the divider plate having a deflector portion that extends over the slots in the slotted plate to direct the flow through the slots in a first direction;

the diffuser further comprising a second slotted plate secured to the frame and said divider plate, said second slotted plate disposed across the second passage, the second slotted plate having a plurality of slots formed therein for air passage, said divider late extending over the slots in both slotted plates to direct the flow through the slots in the first direction and a second direction.

* * * * *

UNITED STATES PATENT AND TRADEMARK OFFICE

CERTIFICATE OF CORRECTION

PATENT NO. : 5,205,784

DATED : April 27, 1993

INVENTOR(S) : DeHart et al.

It is certified that error appears in the above-identified patent and that said Letters Patent is hereby corrected as shown below:

Column 4, line 40, delete the word --late-- and insert the word --plate--.

Signed and Sealed this

First Day of February, 1994

Bruce Lehman

*Attest:*

BRUCE LEHMAN

*Attesting Officer*

*Commissioner of Patents and Trademarks*